US009404293B2

(12) United States Patent
Kudoh et al.

(10) Patent No.: US 9,404,293 B2
(45) Date of Patent: Aug. 2, 2016

(54) VEHICLE DOOR HANDLE DEVICE

(75) Inventors: Shuichi Kudoh, Kanagawa (JP); Shinji Ichikawa, Kanagawa (JP); Ryuichi Yoshida, Kanagawa (JP); Kouji Tsuji, Kanagawa (JP)

(73) Assignees: ALPHA CORPORATION, Yokohama-shi, Kanagawa (JP); NISSAN MOTOR CO., LTD., Yokohama-shi, Kanagawa (JP)

( * ) Notice: Subject to any disclaimer, the term of this patent is extended or adjusted under 35 U.S.C. 154(b) by 87 days.

(21) Appl. No.: 14/113,271

(22) PCT Filed: Mar. 23, 2012

(86) PCT No.: PCT/JP2012/057639

§ 371 (c)(1),
(2), (4) Date: Oct. 22, 2013

(87) PCT Pub. No.: WO2012/144294

PCT Pub. Date: Oct. 26, 2012

(65) Prior Publication Data

US 2014/0049058 A1 Feb. 20, 2014

(30) Foreign Application Priority Data

Apr. 22, 2011 (JP) ..... 2011-095797

(51) Int. Cl.

| | |
|---|---|
| ***E05B 3/00*** | (2006.01) |
| ***E05B 85/14*** | (2014.01) |
| ***E05B 79/06*** | (2014.01) |
| ***E05B 77/38*** | (2014.01) |
| *E05B 85/16* | (2014.01) |

(52) U.S. Cl.

CPC ..... *E05B 85/14* (2013.01); *E05B 77/38* (2013.01); *E05B 79/06* (2013.01); *E05B 85/16* (2013.01); *Y10T 292/57* (2015.04)

(58) Field of Classification Search

USPC ..... 292/336.3

See application file for complete search history.

(56) References Cited

U.S. PATENT DOCUMENTS

| | | | | |
|---|---|---|---|---|
| 7,469,503 | B2 * | 12/2008 | Wesson et al. | 49/475.1 |
| 2008/0197582 | A1 * | 8/2008 | Botten et al. | 277/628 |
| 2010/0205780 | A1 | 8/2010 | Ieda et al. | |

FOREIGN PATENT DOCUMENTS

| | | | |
|---|---|---|---|
| CN | A-101778982 | | 7/2010 |
| JP | UM-A-H07-29233 | | 6/1995 |
| JP | 2008-121363 | A | 5/2008 |
| JP | 2008-248496 | A | 10/2008 |
| JP | 2008248496 | A * | 10/2008 |
| WO | WO 2009/050131 | | 4/2009 |

* cited by examiner

*Primary Examiner* — Mark Williams

(74) *Attorney, Agent, or Firm* — Drinker Biddle & Reath LLP

(57) ABSTRACT

This door handle device is provided with: a handle base; an introduction opening that is opened in a door handle and that supports the handle base; an operation handle that is connected to the handle base; and a gasket that is disposed between the handle base and the operation handle. A handle stopper, of which one end passes through the introduction aperture and is borne by the handle base, and of which the other end contacts the operation handle, is integrally provided to the gasket.

10 Claims, 6 Drawing Sheets

VEHICLE DOOR HANDLE DEVICE

TECHNICAL FIELD

The present invention relates to a door handle device for a vehicle.

BACKGROUND ART

Patent Document 1 discloses a handle device for preventing the occurrence of collision noise when returning to an initial rotational position. In the device disclosed in Patent Document 1, a guide arm is projected in a handle (operation handle) connected to a base member (handle base) and moves between guide walls of the handle base. A cushion member is fixed to a connecting plate portion connecting the lower ends of the guide walls. The cushion member prevents the occurrence of the collision noise by abutting against a lower end of the guide arm when the operation handle is returned to the initial rotational position.

However, in this device, an undercut to a drawing direction of a mold is configured due to the connecting plate portion for connecting the leading ends of the guide walls that are long in a moving direction of the guide arm. Therefore, there is a problem that the structure of a forming mold becomes extremely complex. Furthermore, a separate cushion is required and therefore an increase in the number of components and an increase in the process number of component mounting working are caused.

RELATED ART DOCUMENTS

Patent Document

Patent Document 1: JP-A-2008-121363

SUMMARY OF THE INVENTION

The embodiment of the present invention relates to a door handle device for a vehicle, which is capable of reducing the collision noise of an operation handle at the time of returning with a simple configuration.

MODE FOR CARRYING OUT THE INVENTION

Hereinafter, the embodiments will be described with reference to the drawings. Here, the embodiments are illustrative of the present invention and not intended to limit the present invention. It should be noted that all the features and their combinations described in the illustrative embodiments are not necessarily considered as an essential part of the present invention.

Figure 1:
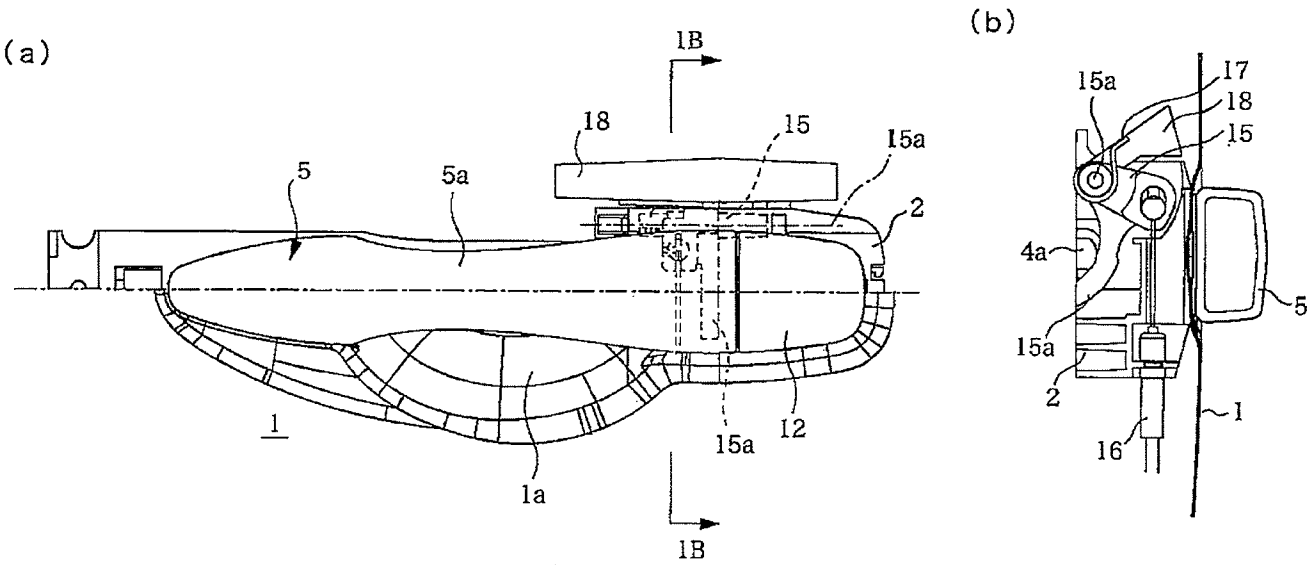
FIG. 1 shows a handle device, in which section (a) is a front view showing the handle device; an upper half thereof shows a state where a door panel is eliminated and a lower half thereof shows a state where the handle device is mounted to the door panel, and section (b) is a sectional view taken along a line 1B-1B in section (a) of FIG. 1.
Figure 2:
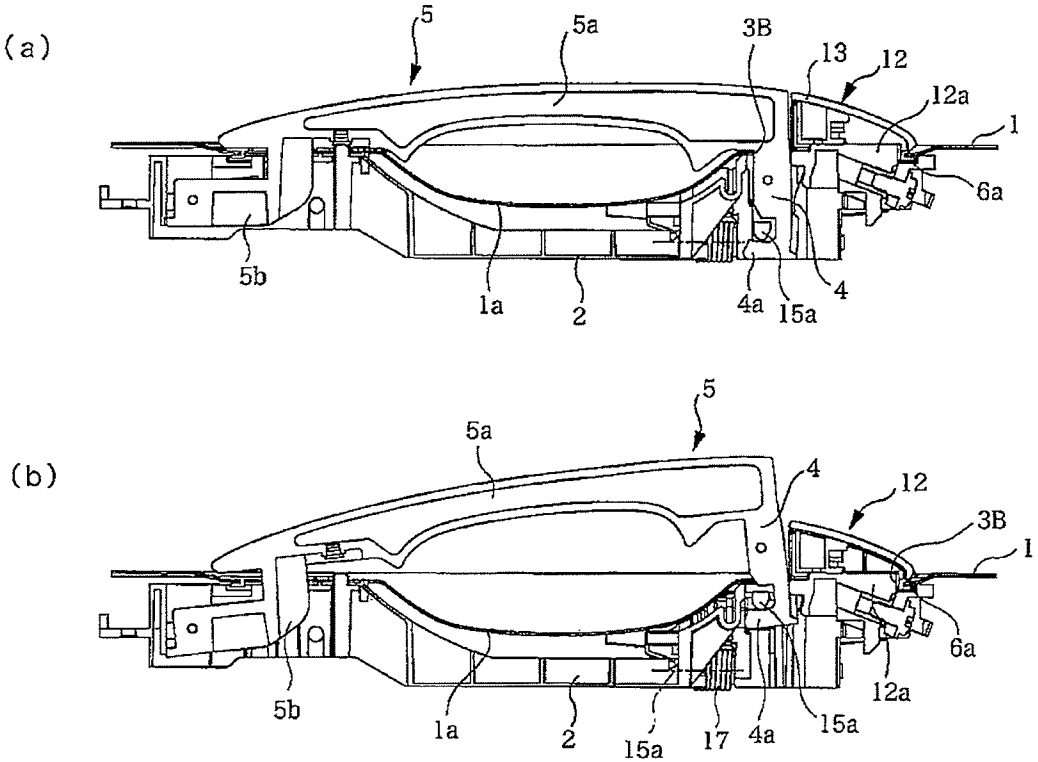
FIG. 2 shows an operation of the handle device, in which section (a) is a longitudinal sectional view showing an initial state of the operation of the handle device and section (b) is a longitudinal sectional view showing an operating state of the operation of the handle device.
Figure 3:
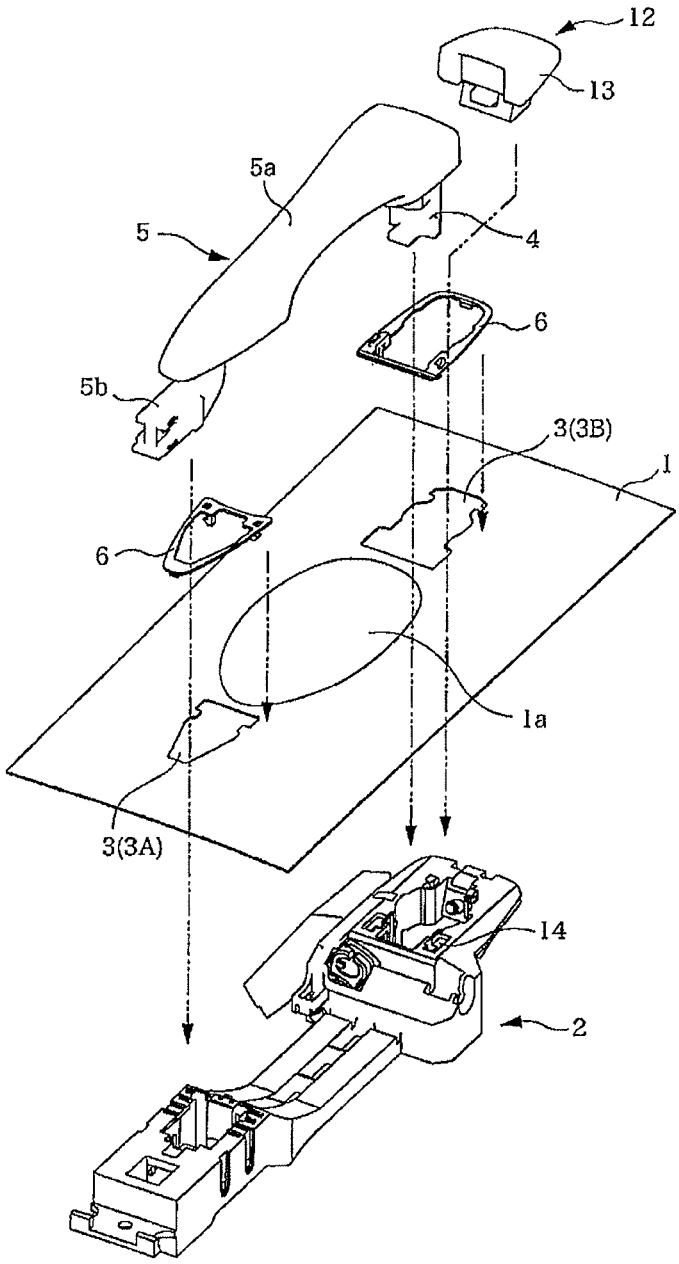
FIG. 3 is an exploded perspective view showing an operation for fixing the handle device to the door panel.

As shown in FIG. 1 to FIG. 3, a door handle device of a vehicle is formed in such a way that an operation handle 5 is rotatably connected to one end of a handle base 2 disposed along a bottom surface of a door panel 1. In this embodiment, the handle device is mounted in a posture where a left side thereof in section (a) of FIG. 1 is directed toward the front of a vehicle. Hereinafter, in the present specification, with reference to a mounting posture to a vehicle, a longitudinal direction of a vehicle is referred to as "a front and rear" and a width direction of a vehicle is referred to as "a top and bottom".

The operation handle 5 includes a grip portion 5*a* corresponding to a handheld recess 1*a* recessed on a top surface of the door panel 1, a hinge leg 5*b* provided on a front end of the grip portion 5*a* and an operation leg 4 provided on a rear end thereof. As shown in FIG. 3, the hinge leg 5*b* is inserted into a door body through a front introduction opening 3A opened in the door panel 1, the operation leg 4 is inserted into the door body through a rear introduction opening 3B of the door panel 1 and then the whole operation handle 5 is mounted while being slid forward. As shown in section (a) of FIG. 5, front and rear openings 2*a*, 2*b* for accommodating the hinge leg 5*b* and the operation leg 4 of the operation handle 5 are opened in the handle base 2.

When the operation handle 5 in a state of being mounted to the handle base 2 is operated to rotate from an initial rotational position shown in section (a) of FIG. 2 to an operating rotational position shown in section (b) of FIG. 2 about a front end thereof, the operation leg 4 is moved in a drawing direction. Then, a lever 15 is mounted to the handle base 2 by locking an actuation arm 15*a* to a locking end 4*a* formed on the operation leg 4 and driven to rotate when an operating force is applied to the actuation arm 15*a*. In response to this, a door lock device (not shown) disposed in a door body is actuated through a cable device 16 connected to the lever 15.

The lever 15 is urged toward the initial rotational position by a torsion spring 17 wrapped around the rotation center 15*a*. As this urging force is transmitted to the operation handle 5, an urging force toward the initial rotational position is applied to the operation handle 5.

Further, in the present embodiment, a counterweight 18 is mounted to the handle base 2 in coaxial with the lever 15 and cancels an inertia force generated in the operation handle 5 when a side collision force is applied to a vehicle, so that an inadvertent door opening operation of the operation handle 2 is prevented.

Figure 4:
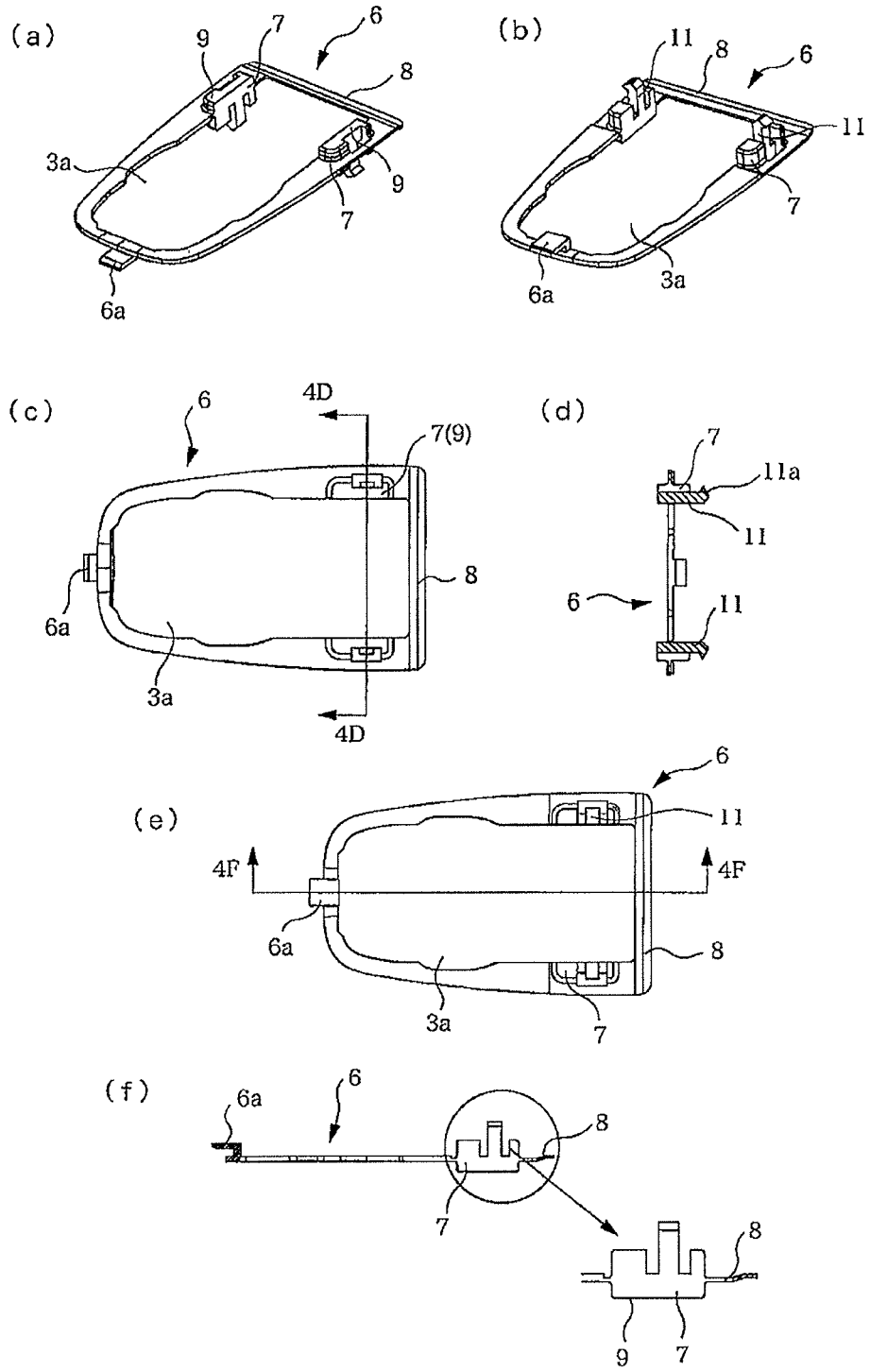
FIG. 4 shows a gasket, in which section (a) is a perspective view of the gasket as viewed from a top surface, section (b) is a perspective view of the gasket as viewed from a bottom surface, section (c) is a plan view of the gasket, section (d) is a sectional view taken along a line 4D-4D in section (c) of FIG. 4, section (e) is a bottom view of the gasket and section (f) is a sectional view taken along a line 4F-4F in section (e) of FIG. 4.

As shown in FIG. 3, in order to prevent a gap in a peripheral edge of the front and rear introduction openings 3, a gasket 6 made of synthetic resin is mounted in a boundary portion between a top surface of the door panel 1 and the operation handle 5. As shown in section (a) to section (f) of FIG. 4, one gasket 6 of two gaskets 6 is arranged in the rear introduction opening 3B side and includes lateral pieces along front and rear side edges of the rear introduction opening 3B and longitudinal pieces connecting these lateral pieces to each other. This gasket 6 is formed in a substantially rectangular frame shape to surround an opening 3*a* of a central portion thereof and the front lateral piece and front ends of the longitudinal pieces are formed in a thickness thinner than the remaining portion. As shown in section (f) of FIG. 4, the thin-walled portion and the remaining thick-walled portion have top surfaces (general surface) flush with each other and are formed in such a way that a plate thickness thereof is variable in a bottom-surface direction, as shown in section (e) of FIG. 4.

The gasket 6 includes a rear locking piece 6*a*, a handle stopper part 7 and an elastic locking leg 11. The rear locking piece 6*a* is arranged at a bottom surface of a center portion of the rear lateral piece and has an L shape section whose free end is directed rearward.

The handle stopper portion 7 is formed into a block shape with a suitable thickness by bulging a widthwise center-side half region of the thin-walled portion of the longitudinal piece in both top and bottom directions and a top surface of the bulging portion toward the top side is used as a stopper surface 9. Further, the bulging portion toward the bottom side is used as a support portion and the elastic locking leg 11 is formed at a part of the support portion.

The elastic locking leg 11 is formed by further extending an inner side edge of a center portion in a longitudinal direction of the protruding portion toward the bottom side and providing a locking protrusion 11*a* projected to the outside at a free end thereof.

Further, the front lateral piece of the gasket 6 is used as a flexible lip piece 8 over the entire length thereof. As shown in section (f) of FIG. 4, the flexible lip piece 8 is formed by bending the free end edge of the gasket toward the bottom side so that a height of a bottom surface thereof substantially coincides with the height of a bottom surface of the thick-walled portion. In this embodiment, in order to give a uniform flexibility over the entire length of the lateral piece and to cause the entire length thereof to serve as the flexible lip piece 8, it is considered that a boundary portion and a front side edge of the opening have a uniform bending value by positioning a bending boundary at a border of the lateral piece and longitudinal piece that are disposed on a straight line continuous to the front side edge of the opening 3*a* and forming the bending boundary as a straight changing point rather than the curvature surface.

Figure 5:
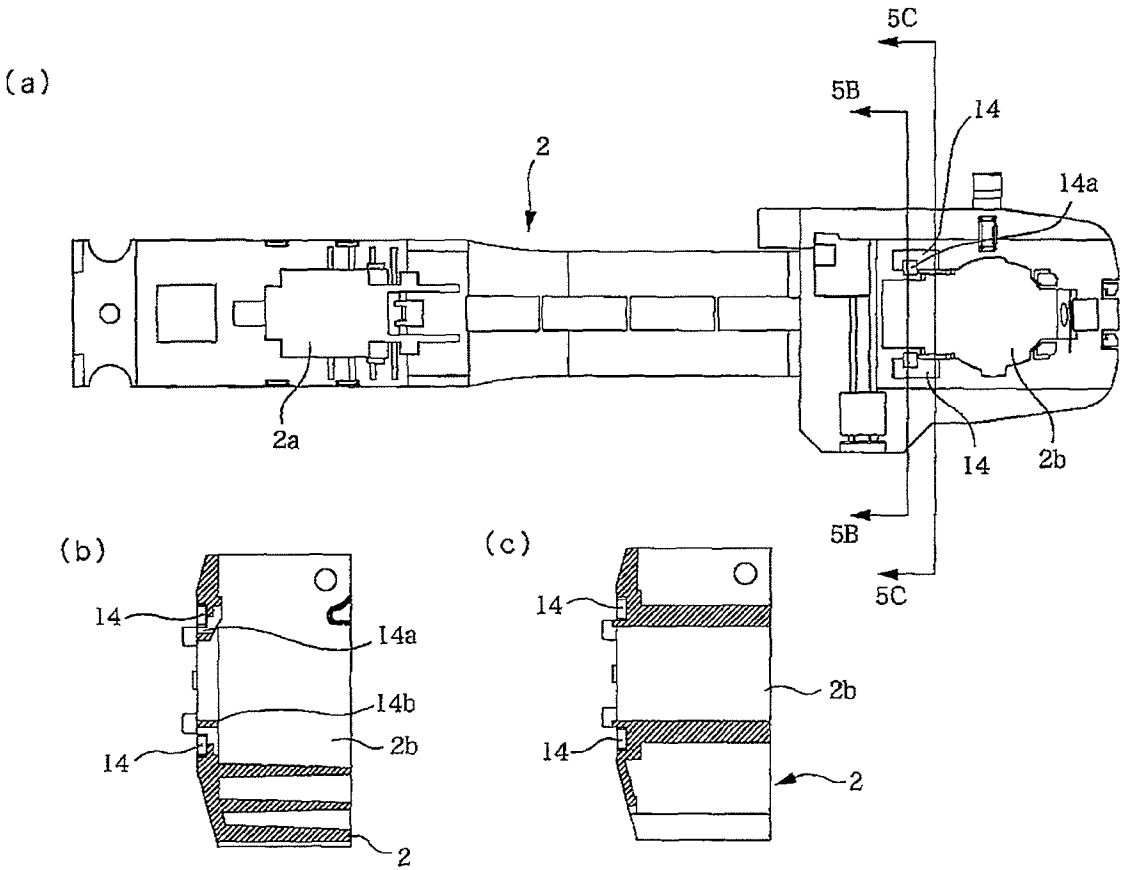
FIG. 5 shows a handle base, in which section (a) is a front view of the handle base, section (b) is a sectional view taken along a line 5B-5B in section (a) of FIG. 5 and section (c) is a sectional view taken along a line 5C-5C in section (a) of FIG. 5.

The handle base 2 for supporting the gasket 6 is shown in section (a) of FIG. 5. As described above, although the lever 15 or the like is mounted to the handle base 2, section (a) of FIG. 5 shows the handle base without the mounted parts such as the lever 15, for ease of understanding.

As shown in section (a) of FIG. 5, at the top surface of the handle base 2, fitting recesses 14 are formed at positions corresponding to the support portion of the gasket 6. On a portion of the fitting recess 14, a leg penetrating hole 14*a* is opened so as to correspond to the elastic locking leg 11 of the gasket 6 and a locked portion 14*b* to which the locking protrusion 11*a* of the elastic locking leg 11 can be locked is formed at a lower end of the leg penetrating hole 14*a*. The gasket 6 is retained on the door panel 1 by locking the rear locking piece 6*a* to a front end edge of the rear introduction opening 3B and resiliently locking the elastic locking leg 11 to the locked portion 14*b* of the handle base 2, as shown in section (d) of FIG. 6.

As described above, the handle device using the handle base 2 thus configured is mounted by connecting the operation handle 5 to the handle base 2 temporarily fixed to the door panel 1 in advance and a rear end of the handle device is made by connecting the fixing member 12 to the handle base 2.

In addition to fixing the handle base 2 to the door panel 1, the fixing member 12 has a function to prevent the detachment of the operation handle 5 by restricting a rearward sliding movement of the operation handle 5. As shown in section (a) of FIG. 1, the fixing member 12 includes a pressing head 13 exposed to the outside of the door panel 1 by a size to cover an peripheral edge of the rear introduction opening 3B of the door panel 1 and a shaft portion 12*a* protruding from a bottom surface of the pressing head 13. The fixation of the fixing member 12 is made by inserting the shaft portion 12*a* into the rear opening 2*b* opened in the handle base 2 and then screwing the shaft 12*a* to the handle base 2.

The fixing member 12 is drawn obliquely rearward in a vehicle width direction by the screwing operation of the shaft portion 12*a* and a peripheral edge portion of the rear introduction opening 3B of the door panel 1 is sandwiched by the pressing head 13 and the top surface of the handle base 2. As a result, the handle base 2 is fixed to the door panel 1 so as not to be detached therefrom.

The thick-walled portion of the gasket 6 corresponds substantially to a bottom surface of the pressing head 13 of the fixing member 12. As shown in section (b) of FIG. 6, in a state where the fixing member 12 is fixed, the thick-walled portion of the gasket 6 is strongly sandwiched between the door panel 1 and the pressing head 13 to completely close a gap between the fixing member 12 and the door panel 1.

In a state where the thick-walled portion is completely fixed, a support portion of the handle stopper part 7 formed on the thin-walled portion is fitted into the fitting recess 14 of the handle base 2 and the stopper surface 9 of the handle stopper part 7 projected toward the top surface than the general surface of the gasket 6 abuts against a ceiling wall of the stopper recess 10 recessed at a base end of the operation leg 4 of the operation handle 5, thereby determining an initial rotational position side stroke end of the operation handle 5.

Figure 6:
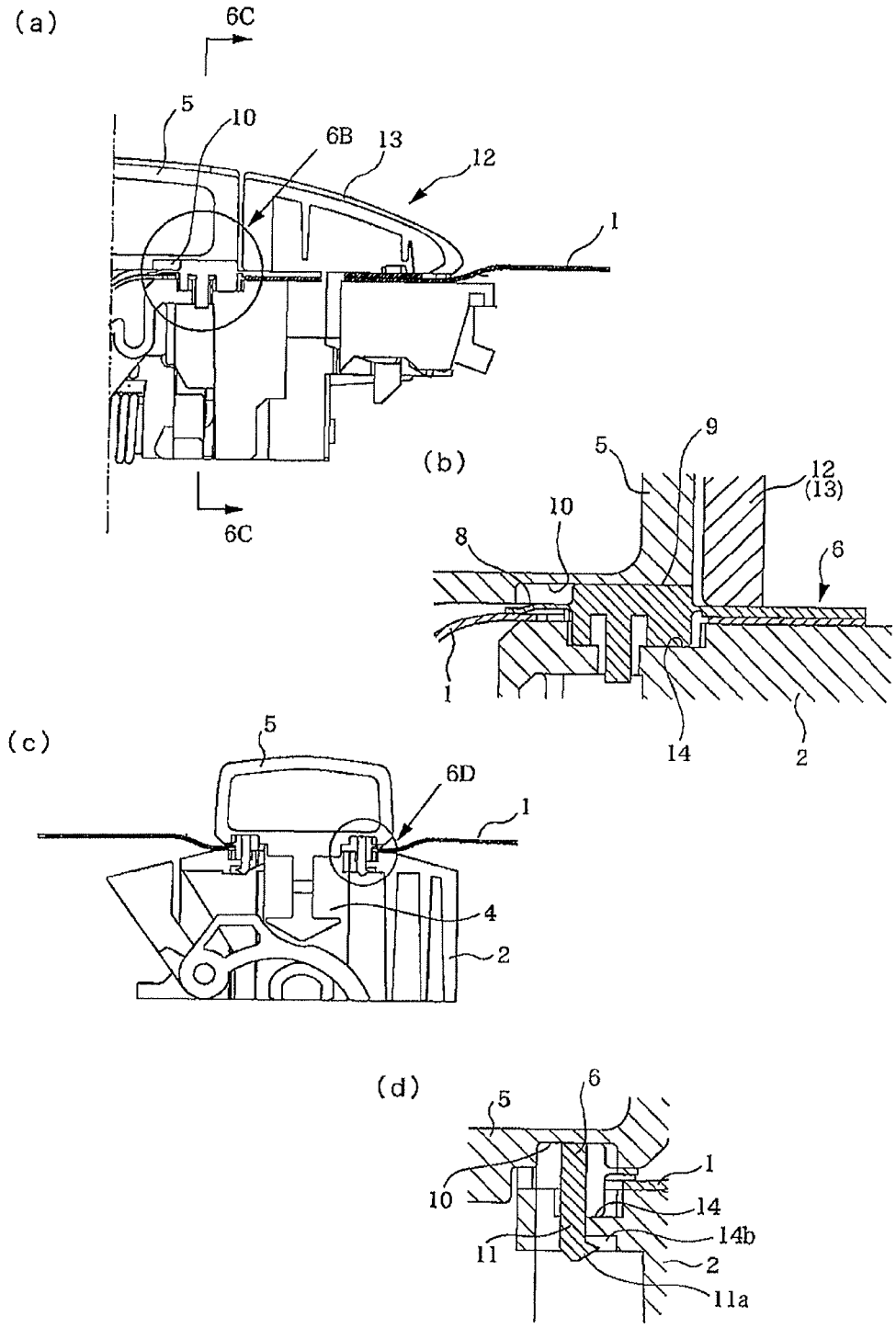
FIG. 6 shows enlarged views of essential parts showing a mounted state of the gasket, in which section (a) is a sectional view, section (b) is an enlarged view of "6B" portion in section (a) of FIG. 6, section (c) is a sectional view taken along a line 6C-6C in section (a) of FIG. 6 and section (d) is an enlarged view of "6D" portion in section (c) of FIG. 6.

Meanwhile, the thin-walled portion of the gasket 6 is located at a height slightly floated from the top surface of the panel, as shown in section (d) of FIG. 6 and a leading end of the flexible lip piece 8 is brought into contact with the top surface of the door panel 1 to configure a sealing edge, as shown in section (b) of FIG. 6.

In this state, the operation handle 5 is rotated to an initial rotational position by an urging force when the operation handle 5 is operated and then an operating force thereto is released. At this time, the stopper recess 10 of the operation handle 5 collides with the stopper surface 9 of the gasket 6 and therefore the operation handle is stopped at the initial rotational position. As shown in section (a) to section (d) of FIG. 6, the handle stopper passes through the rear introduction opening 3 of the door panel 1 and a support portion thereof is directly supported by the fitting recess 14 of the handle base 2. In addition, the thin-walled portion is floated from the top surface of the door panel 1 and thus not in direct contact with the door panel 1. Accordingly, the impact noise or the like is not propagated to the door panel 1 and amplification of noise or vibration of the door panel 1 does not occur.

In this case, since the impact absorbing performance is also expected when the gasket 6 is formed of somewhat flexible synthetic resin material, it is possible to reliably prevent the propagation of the impact noise or the like.

Further, as described above, in a state where the fixing member 12 is fixed, the flexible lip piece 8 abuts against the top surface of the door panel 1 to configure the sealing edge and therefore inundation through the sealed portion is prevented.

Although an example where the gasket 6 is formed to have a frame piece abutting against only the top surface of the door panel 1 has been described in the foregoing description, the gasket 6 may be formed to have a pair of frame pieces opposed to each other so as to sandwich the door panel 1 by abutting against the top and bottom surface of the door panel 1.

According to the above embodiment, the door handle device for a vehicle may include the handle base 2 disposed along a bottom surface of the door panel 1, the introduction opening 3 opened in the door panel 1 and supporting the handle base 2 therein, the operation handle 5 connected to the handle base 2 and the gasket 6 disposed between the handle base 2 and the operation handle 5. The gasket 6 may be formed of an elastic body. The gasket 6 may be integrally provided with the handle stopper part that has one end passing through the introduction opening 3 and supported by the handle base 2 and the other end abutting against the operation handle 5.

Further, according to the above embodiment, the door handle device may include the handle base 2 that is disposed along a bottom surface of the door panel 1, the operation handle 5 that has one end connected to the handle base 2 and the other end provided with the operation leg 4 entering into a door body through the introduction opening 3 opened in the door panel 1 and is capable of rotating from an initial rotational position to an operating rotational position and the gasket 6 that has a frame shape and is disposed at a peripheral edge of the introduction opening 3. The gasket 6 includes the handle stopper part 7 that is provided at a frame piece of the gasket 6, has one end passing through the introduction opening 3 and supported by the handle base 2 and determines an initial rotational position side stroke end of the operation handle 5 and the flexible lip piece 8 that is projected in a side edge of the frame piece so as to be resiliently deformable and whose free end edge abuts against a top surface of the door panel 1 to form a sealing edge between the top surface of the door panel 1 and the free end edge.

According to the above structure, the operation handle 5 connected to the handle base 2 is provided at its one end with the operation leg 4 that is inserted into a panel body through the introduction opening 3 opened in the door panel 1 (in this case, "one end" as used herein refers to not only a leading end of a narrow region but also a suitable range from one-side leading end to an intermediate portion and the operation handle 5 of the present invention also includes the operation handle 5 that is connected to the handle base 2 at a site shifted toward the other end from a leading end thereof). The gasket 6 is disposed on the top surface of the door panel 1 so as to surround the introduction opening 3. The handle stopper part 7 is formed in the gasket 6 and adapted to restrict the position of an initial rotational position side stroke end of the operation handle 5.

According to the above structure, since the gasket 6 is integrally formed with the handle stopper part 7, a particular part is not necessary as a stopper. Therefore, it is possible to achieve the reduction in the number of parts and, accordingly, the reduction in the mounting man-hour. Further, according to the above structure, the handle stopper part 7 is configured in such a way that a lower end thereof passes through the introduction opening 3 and is supported by the handle base 2. Accordingly, the collision noise generated when the operation handle 5 collides with the handle stopper part 7 is not propagated to the door panel 1. Since the handle base 2 has a resonance capacity lower than the thin plate-shaped door panel 1, the collision noise is not expanded and therefore it is possible to improve the quietness.

According to the above structure, the gasket 6 is further provided with the flexible lip piece 8 that is projected in a cantilever manner so as to be resiliently deformable. Sealing edge is formed at the abutted portions by abutting a free end edge of the flexible lip piece 8 against the top surface of the door panel 1, so that shielding performance to the regions requiring waterproof or the like is also ensured.

The gasket 6 is formed into a generally sheet shape and the transmission performance of the impact received in the handle stopper part 7 thereof is low by its nature.

However, the frame piece of the gasket 6 may be formed so that a portion thereof other than the sealing edge is disposed at a position suitably spaced and floated from the top surface of the door panel 1. According to this structure, the impact noise or the like can be completely prevented from being propagated to the door panel 1.

The handle stopper part 7 can be variously modified, as long as the handle stopper part can abut against the corresponding portion of the operation handle 5 when the operation handle 5 is in an initial rotational position. For example, the top surface of the handle stopper part 7 can be set flush with the general surface of the gasket 6 or at a position that is recessed from the general surface. Further, in a case where a lower end of the handle stopper part 7 is supported by the handle base 2, the thickness dimension of the handle stopper part 7 is not limited. When the thickness dimension of the handle stopper part 7 is set to be larger, the sound absorption capacity and impact absorption capacity of the handle stopper part 7 itself can be expected and therefore it is possible to further improve the quietness.

In the above structure, the handle stopper part 7 may be formed in a block shape whose stopper surface 9 is projected to a suitable height from the top surface of the door panel 1. Further, the operation handle 5 may be formed with the stopper recess 10 that includes an abutting portion abutting against the stopper surface 9 and accommodates the handle stopper part 7. According to this structure, it is possible not only to arrange the thick-walled handle stopper part 7 within a small space but also to expect a sealing performance for the fitting region of the handle stopper part 7 to the stopper recess 10 of the operation handle 5.

The shape, position and connecting target of the connecting means for preventing the detachment of the gasket 6 can be suitably determined.

According to the above embodiment, the elastic locking leg 11 may be formed at a support portion of the handle stopper part 7 to the handle base 2 and the elastic locking leg 11 may be resiliently locked to the handle base 2 to restrict the detachment of the gasket 6.

According to the above structure, since the elastic locking leg 11 is connected to the handle base 2, impact on the handle stopper part 7 is transmitted through the elastic locking leg 11 and therefore prevented from being propagated to the door panel 1. Furthermore, since the elastic lock leg 11 is formed at a part of the handle stopper part 7 penetrating the introduction opening 3, it is not necessary to consider a new sealing portion.

The door handle device may be configured in such a way that a portion thereof is covered with the fixing member 12 fixing the handle base 2 to the door panel 1, instead of covering the entire peripheral edge region of the introduction opening 3 with a base end portion of the operation leg 4.

According to the above embodiment, a rear end of the gasket 6 may be interposed and compressed between the top surface of the door panel 1 and the pressing head 13 of the fixing member 12 fixing a rear end of the handle base 2 to the door panel 1. The flexible lip piece 8 may be disposed over the entire length of a front end of the gasket 6. The handle stopper part 7 is formed at the substantially entire region of the gasket 6 except for a portion to be pressed by the pressing head 13 and the frame piece having the flexible lip piece 8 formed thereon and the handle stopper part 7 includes a lower end to be fitted into the fitting recess 14 formed in the handle base 2.

According to the structure of the above embodiment, since the collision noise of the operation handle at the time of returning can be prevented from being propagated to the door panel with a simple configuration, it is possible to reduce the collision noise and to effectively suppress the vibration or the like of the door panel.

DESCRIPTION OF REFERENCE NUMERALS AND SIGNS

1 Door Panel
2 Handle Base
3 Introduction Opening
4 Operation Leg
5 Operation Handle
6 Gasket
7 Handle stopper part
8 Flexible Lip Piece
9 Stopper Surface
10 Stopper Recess
11 Elastic Locking Leg
12 Fixing Member
13 Pressing Head
14 Fitting Recess

The invention claimed is:

1. A door handle device configured to be installed in a door panel for a vehicle, the door handle device comprising:

a handle base configured to be disposed along a bottom surface of the door panel and supported in an introduction opening opened in the door panel;

an operation handle connected to the handle base; and a gasket disposed between the handle base and the operation handle, wherein the gasket is formed of an elastic body and the gasket is integrally provided with a handle stopper part that has an inner end configured to pass through the introduction opening, the handle stopper part being supported by the handle base and having an outer end abutting against the operation handle, wherein a surface of the inner end perpendicular to a direction that the inner end is configured to pass through the introduction opening directly abuts against the handle base.

2. The door handle device for the vehicle according to claim 1, wherein the gasket comprises (a) the handle stopper part that is provided at a frame piece of the gasket, has the inner end passing through the introduction opening and supported by the handle base and defines an initial rotational position of the operation handle, and (b) a flexible lip piece that is projected in a side edge of the frame piece of the gasket so as to be resiliently deformable and whose free end edge abuts against a top surface of the door panel to form a sealing edge between the top surface of the door panel and the free end edge.

3. The door handle device for the vehicle according to claim 2, wherein the frame piece of the gasket is formed so that a portion thereof other than the sealing edge is disposed at a position suitably spaced from the top surface of the door panel.

4. The door handle device for the vehicle according to claim 2, wherein the handle stopper part is formed in a block shape whose stopper surface is projected to a suitable height from the top surface of the door panel and, the operation handle is formed with a stopper recess that includes an abutting portion abutting against the stopper surface and accommodates the handle stopper part.

5. The door handle device for the vehicle according to claim 4, wherein an elastic locking leg is formed at a support portion of the handle stopper part to the handle base and the elastic locking leg is resiliently locked to the handle base to restrict detachment of the gasket.

6. The door handle device for the vehicle according to claim 2, wherein a rear end of the gasket is interposed and compressed between the top surface of the door panel and a pressing head of a fixing member fixing a rear end of the handle base to the door panel, the flexible lip piece is disposed over the entire length of a front end of the gasket, and the handle stopper part is formed at the substantially entire region of the gasket excluding a portion to be pressed by the pressing head and the frame piece having the flexible lip piece formed thereon and the handle stopper part includes a lower end to be fitted into a fitting recess formed in the handle base.

7. The door handle device for the vehicle according to claim 3, wherein a rear end of the gasket is interposed and compressed between the top surface of the door panel and a pressing head of a fixing member fixing a rear end of the handle base to the door panel, the flexible lip piece is disposed over the entire length of a front end of the gasket, and the handle stopper part is formed at the substantially entire region of the gasket excluding a portion to be pressed by the pressing head and the frame piece having the flexible lip piece formed thereon and the handle stopper part includes a lower end to be fitted into a fitting recess formed in the handle base.

8. The door handle device for the vehicle according to claim 4, wherein a rear end of the gasket is interposed and compressed between the top surface of the door panel and a pressing head of a fixing member fixing a rear end of the handle base to the door panel, the flexible lip piece is disposed over the entire length of a front end of the gasket, and the handle stopper part is formed at the substantially entire region of the gasket excluding a portion to be pressed by the pressing head and the frame piece having the flexible lip piece formed thereon and the handle stopper part includes a lower end to be fitted into a fitting recess formed in the handle base.

9. The door handle device for the vehicle according to claim 5, wherein a rear end of the gasket is interposed and compressed between the top surface of the door panel and a pressing head of a fixing member fixing a rear end of the handle base to the door panel, the flexible lip piece is disposed over the entire length of a front end of the gasket, and the handle stopper part is formed at the substantially entire region of the gasket excluding a portion to be pressed by the pressing head and the frame piece having the flexible lip piece formed thereon and the handle stopper part includes a lower end to be fitted into a fitting recess formed in the handle base.

10. The door handle device for the vehicle according to claim 1, wherein the handle stopper part is formed bulging widthwise in both top and bottom directions.

* * * * *